US009885153B2

(12) United States Patent
Meitner et al.

(10) Patent No.: US 9,885,153 B2
(45) Date of Patent: Feb. 6, 2018

(54) DEVICE FOR FORMING AN EXTENDED NIP

(71) Applicant: Andritz Küsters GmbH, Krefeld (DE)

(72) Inventors: Robert Meitner, Krefeld (DE); David Lange, Beloit, WI (US); Andreas Anzel, Graz (AT); Wilhelm Mausser, Graz (AT)

(73) Assignee: Andritz Küsters GmbH, Krefeld (DE)

( * ) Notice: Subject to any disclaimer, the term of this patent is extended or adjusted under 35 U.S.C. 154(b) by 143 days.

(21) Appl. No.: 14/893,641

(22) PCT Filed: May 27, 2014

(86) PCT No.: PCT/EP2014/001424
§ 371 (c)(1),
(2) Date: Nov. 24, 2015

(87) PCT Pub. No.: WO2014/191101
PCT Pub. Date: Dec. 4, 2014

(65) Prior Publication Data

US 2016/0108579 A1 Apr. 21, 2016

(30) Foreign Application Priority Data

May 29, 2013 (EP) ..... 13002777

(51) Int. Cl.
*D21F 3/02* (2006.01)
*D21G 1/00* (2006.01)

(52) U.S. Cl.
CPC ..... *D21G 1/006* (2013.01); *D21F 3/0209* (2013.01); *D21F 3/0218* (2013.01)

(58) Field of Classification Search
CPC ..... D21F 3/02; D21F 3/0209; D21F 3/0218; D21F 3/06; D21F 3/045; D21G 1/006
(Continued)

(56) References Cited

U.S. PATENT DOCUMENTS 4,713,147 A * 12/1987 Saarinen ..... D21F 3/0218 100/118
6,174,272 B1 * 1/2001 Savia ..... B30B 3/005 492/16

(Continued)

FOREIGN PATENT DOCUMENTS

| | | | |
|---|---|---|---|
| DE | 3030233 | A1 | 2/1982 |
| EP | 1505204 | A1 | 2/2005 |
| WO | WO2005/042834 | A1 | 5/2005 |

OTHER PUBLICATIONS

English Translation of the International Preliminary Report on Patentability corresponding to PCT/EP2014/001424 dated Dec. 1, 2015.

(Continued)

*Primary Examiner* — Eric Hug
(74) *Attorney, Agent, or Firm* — Kilpatrick Townsend & Stockton LLP

(57) ABSTRACT

Disclosed is a device for forming an extended nip between a counter roll and a shoe roll for machining a material web, wherein the shoe roll has a support and a flexible roll shell, which can rotate around the support (4) and which rests in the region of the extended nip upon a head surface of a press shoe guided on the support, and the press shoe displaceably rests on the support in order to generate a press pressure via a pressure chamber to which fluid can be applied, the pressure chamber is disposed as a pressure pad, on which the press shoe rests surficially on the rear side, wherein the pressure pad is inserted into a groove-like chamber, wherein the press shoe has a stamp-like section on the rear side, which stamp-like section descends into an invaginable pressure pad in order to perform reciprocating movements, and the pressure pad is guidedly supported on the groove-like chamber along a pressure pad lateral wall that forms a roll wall.

14 Claims, 12 Drawing Sheets

(58) Field of Classification Search
USPC ..... 162/358.3; 100/156
See application file for complete search history.

(56) References Cited

U.S. PATENT DOCUMENTS 7,527,708 B2 * 5/2009 Gustavsson ..... D21F 3/0218
100/156
7,722,744 B2 * 5/2010 Mueller ..... D21F 3/0218
100/118

OTHER PUBLICATIONS

International Search Report corresponding to PCT/EP2014/001424 dated Jun. 16, 2014.
European Search Report corresponding to EP13002777 dated Jul. 13, 2015.

* cited by examiner

DEVICE FOR FORMING AN EXTENDED NIP

The invention relates to an apparatus for forming an extended nip between a mating roll and a shoe roll for treating a material web, in particular a paper web, a board web, a tissue web, or any other fibrous web.

Apparatus of this type are used in particular in press sections and calendars.

DE 30 30 233 C3 discloses a wet press for dewatering fibrous webs, in which an elongated press zone is applied so as to substantially increase dewatering as compared with other press rolls. On account of a concave shape of the sliding face of the sliding shoe, an elongated press nip through which the fibrous web passes is formed between a mating roll and a rotating belt on which a sliding shoe bears from the inside. The rotating belt is held in a substantially roll-like shape by annular discs which are fastened to the end sides of the belt. The sliding shoe is fastened to a shoe base which is connected to a stationary yoke by way of a pressure cushion from an elastic material, for example plastics or rubber, and in relation to said yoke is guided in the direction of pressure by pins and transversely thereto is held in a form-fitting manner. Metal strips serve for fastening the pressure cushion to the shoe base and to the yoke.

The space which is enclosed by the pressure cushion is loadable via lines by a fluid, such that it is possible for the contact pressure of the sliding shoe on the mating roll to be varied. The pressure cushion here is disposed such that the resulting force applied by the pressure cushion on the sliding shoe in the running direction of the roll circumference runs through the second half of the formed press nip. As a result, a slow increase in pressure which thereafter at the end of the press zone rapidly decreases is caused, being advantageous for a dewatering operation. In order to be able to adjust different contact pressures across the roll width, the pressure cushion may be axially subdivided into zones. It is disadvantageous that the pressure cushion from an elastic material, for example plastics or rubber, is liable to wear. The cost advantages of pressure cushions as compared to more complex cylinder-type loading systems are therefore often lost on account of comparatively short maintenance intervals.

U.S. Pat. No. 4,713,147 discloses a wet press having an elongated press nip, in which two separate pressure cushions are provided for adjusting the line load along the length of the press zone of the press nip. Thereby, the shape of the pressure curve is better adjustable. However, the disadvantages mentioned above apply in a corresponding manner.

It is therefore an object of the invention to provide an apparatus for forming an extended nip according to the preamble of Claim 1, in which the press shoe by way of a fluid-loadable pressure cushion as a contact pressure unit is pressable against the mating roll and the pressure cushion here operates with low wear.

This object is achieved by the features of Claim 1.

By this means, an apparatus for forming an extended nip is provided, in which all frictional effects between a male form portion of the press shoe and the pressure cushion, on the one hand, and the groove-type chamber and the pressure cushion, on the other hand, are avoided. While avoiding stick-and-slip effects, the pressure cushion can be unfolded by the lateral guide of a rollable wall from a flat first profile to a higher second profile, by which a lifting movement of the press shoe is performed. The lifting movement enables displacement of the press shoe in relation to the roll shell and adjustment of a pressure in the extended nip. The pressure cushion is thus subject to substantially lower wear.

According to the invention the loading of the pressure cushion with fluid is a hind of inflating fluid loading, in which the rollable wall always forms a rolling fold which is maintained in all operational states. The rolling behaviour of the rollable wall enables guiding of a male form portion of the shoe, which extends in an axial manner along a shoe length which typically runs in a transverse manner to the machine direction (MD).

According to preferred exemplary embodiments, the pressure cushion is made from a flexible material which also configures the rollable wall having a rolling fold. Here, the male form portion of the press shoe between two axially extending rolling folds projects into the pressure cushion while sinking the latter.

It is furthermore advantageous that the pressure cushion is formed by a fluid-loadable flexible tube, the two material layers of said tube, which in the cross section are disposed on top of one another, are placed in a U-shape in the groove-type chamber in such a manner that the tube folds of the leg ends of the tube which is place in a U-shaped manner form the rollable wall. The rollable wall is then configured so as to be integral with the pressure cushion, as a result which a pressure cushion which can be readily and rapidly fitted is moreover achieved. Alternatively, a forming part having a rollable wall which is clamped at the end sides may be provided.

Furthermore, a several of pressure cushions can be provided longitudinally across shoe width in the machine direction, having assigned one male form portion of the press shoe, respectively. Setting of the line load along the press zone length of the extended nip is then variable.

In order for different contact pressures to be able to be set across the shoe length, that is to say across the roll width in a transverse direction to the machine direction, the pressure cushion may be axially subdivided into zones. Alternatively or additionally, the male form portion of the press shoe can plunge into the pressure cushion or pressure cushions by way of variably sized contact areas. Thus, peripheral loading or load relief of the press shoe is adjustable. Moreover, additional cylinder-type loading installations, by way of which the line load profile along the press zone in the extended nip may be varied, can also be provided.

Further refinements of the invention can be gathered from the following description and the dependent claims.

The invention will be explained in more detail below by using the exemplary embodiments illustrated in the appended figures, in which:

FIG. 1*a* shows schematically an apparatus for forming an extended nip, having a shoe roller according to a first exemplary embodiment, in the cross section and in a partial manner;

FIG. 1*b* shows schematically an apparatus for forming an extended nip, having a shoe roll according to a second exemplary embodiment, in the cross section and in a partial manner;

FIG. 2*a* shows schematically the apparatus according to FIG. 1*a*, having a pressure cushion at a higher profile;

FIG. 2*b* shows schematically the apparatus according to FIG. 2*a*, for a third exemplary embodiment;

FIG. 2*c* shows schematically a flat first profile and a higher second profile of a pressure cushion;

FIG. 3*a* shows schematically the apparatus according to FIG. 2*a*, for a fourth exemplary embodiment;

FIG. 3*b* shows schematically the apparatus according to FIG. 2*a*, for a fifth exemplary embodiment;

FIG. 3*c* shows schematically the apparatus according to FIG. 2*a*, for a sixth exemplary embodiment;

Figures 7A, 7B, 7C, 7D:
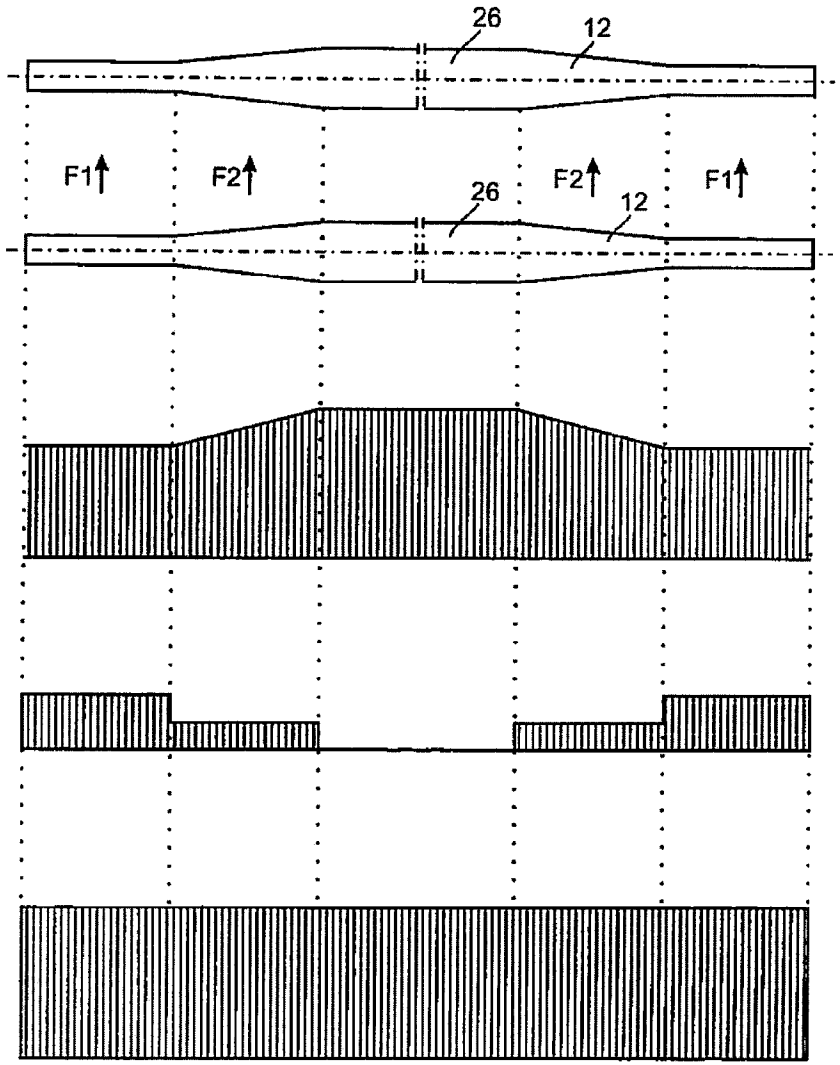
Figures 8A, 8B, 8C, 8D:
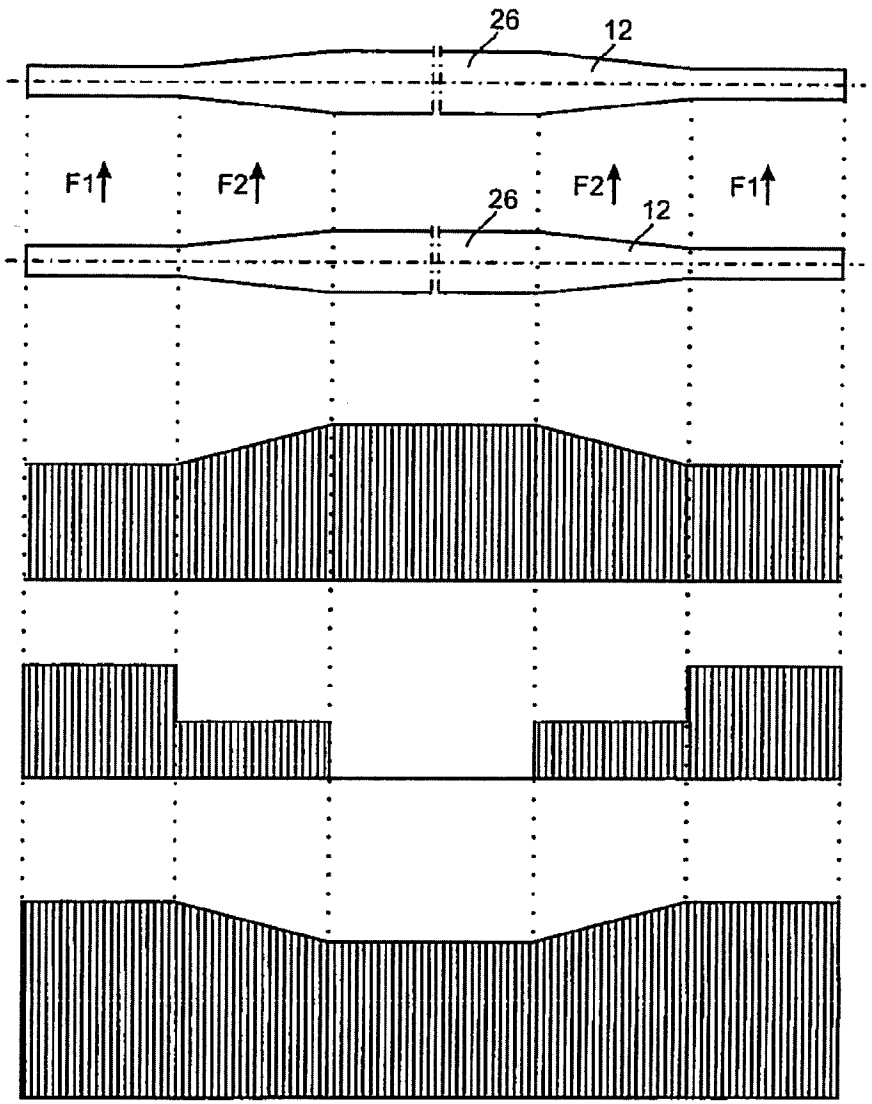

FIG. 7*a* and FIG. 8*a* show male form portions which taper off in the end region;

FIGS. 7*b* to 7*d* and FIGS. 8*b* to 8*d* show different line load curves along a press zone in the extended nip.

Figure 1A:
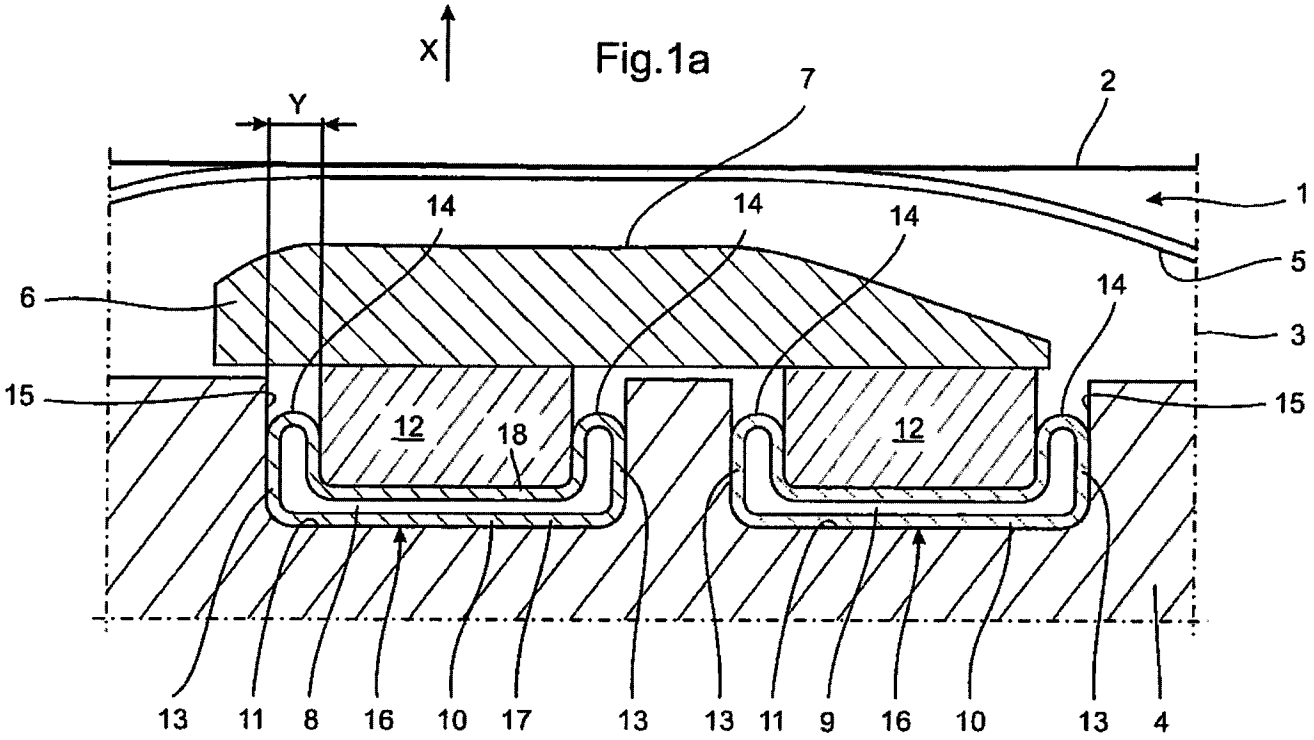
Figure 2C:
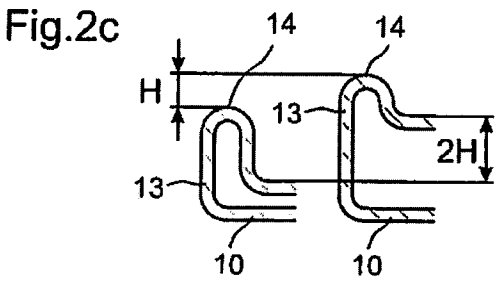
Figure 2A:
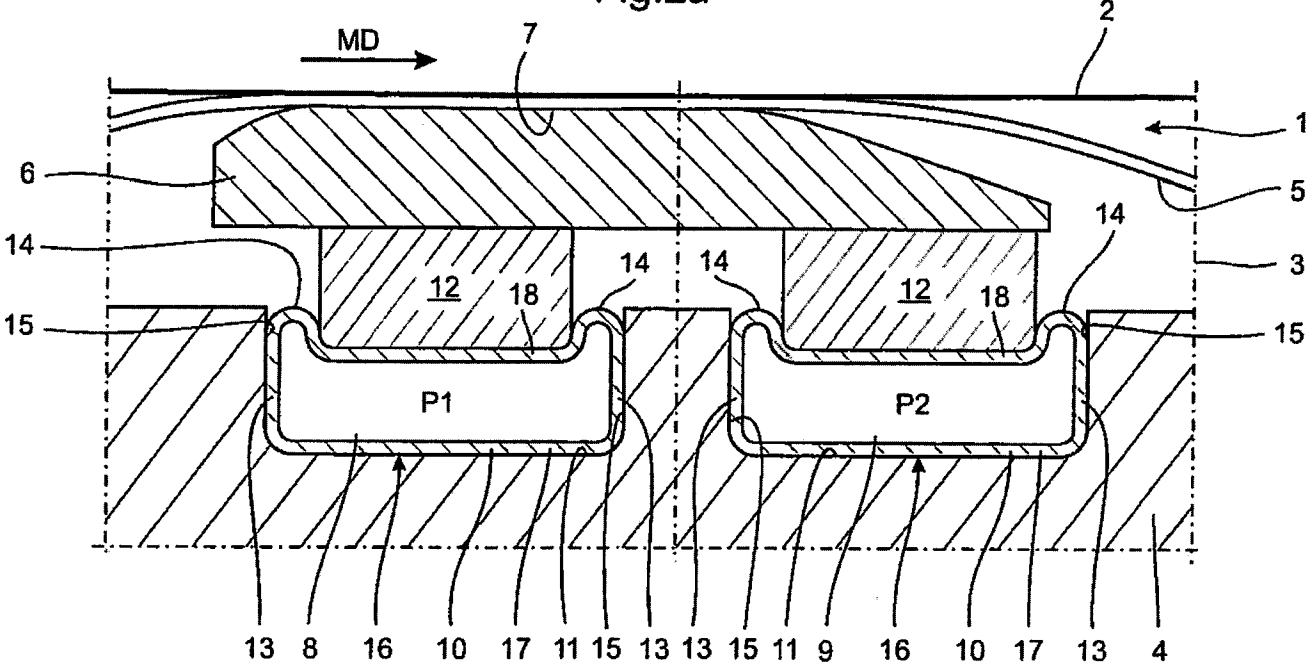

As shown in FIG. 1*a* and FIG. 2*a*, the invention according to a first exemplary embodiment relates to an apparatus for forming an extended nip 1 between a mating roll 2 and a shoe roll 3 for treating a material web. The material web is in particular a paper web, a board web, a tissue web, or any other fibrous web.

The shoe roll 3 comprises a carrier 4 and a flexible roll shell 5 which is rotatable about the carrier 4. The carrier 4 is preferably configured as a stationary yoke. The roll shell 5 in the region of the extended nip 1 is supported on a head face 7 of a press shoe 6 which is guided on the carrier 4. The press shoe 6 for generating a pressure by way of at least one fluid-loadable pressure chamber, presently, according to the first exemplary embodiment, the pressure chambers 8, 9, is movably supported on the carrier 4.

The pressure chamber 8, 9 is configured as a pressure cushion 10 on which the press shoe 6 by way of the rear side is supported in a planar manner, wherein the pressure cushion 10 is placed in a groove-type chamber 11.

The press shoe 6 on the rear side has at least one male form portion 12 or a base, respectively, which for performing lifting movements projects into at least one pressure cushion 10 which can be sunk. To this end, the pressure cushion 10 is supported in a guiding manner by way of a pressure-cushion side wall, which forms a rollable wall 13, on the groove-type chamber 11. This can be achieved by the pressure cushion 10 being made from a flexible material.

The rollable wall 13 forms a rolling fold 14 between the male form portion 12 of the press shoe 6 and an inner side wall 15 of the grove-type chamber 11. The rolling behaviour of the rollable wall 13 determines a lifting length in the lifting direction. Preferably, a clear height H of the groove-type chamber 11 should be at least half of the lifting movement of the press shoe 6 in the direction of pressure X, as is clarified in FIG. 2*c*.

A spacing Y between the male form portion 12 of the press shoe 6 and the inner side wall 15 of the groove-type chamber 11 is selected such that the rollable wall 13 during displacement of the male form portion 12 in the lifting direction is pressed against the inner side wall 15 of the groove-type chamber 11.

A substantial advantage of the pressure cushion 10 also lies in that the compression surface of the pressure cushion 10 which acts on the male form portion 12 is independent of the lifting movements, as is shown in FIG. 1*a* in conjunction with FIG. 2*a*.

As a pressure cushion 10, a fluid-loadable flexible tube 16 is preferably placed in the axially extending groove-type chamber 11. The two material layers 17, 18, of the tube 16, which in the cross section are disposed on top of one another, are placed in a U-shape in the groove-type chamber 11 in such a manner that the tube folds of the leg ends of the tube which is placed in a U-shaped manner form the rollable wall 13. The male form portion 12, which is engaged for lifting with the pressure cushion 10, while performing lifting movements is enclosed by the tube 16 in a U-shaped cross-sectional manner.

The tube 16 preferably consists of a fibre-reinforced plastic material or of a fibre-reinforced rubber compound. The rollable wall 13 is then configured so as to be integral with the tube 16.

The press shoe 6 is brought into contact with the mating roll 2 or a mating element and pressed there against by way of at least one pressure, and when two pressure cushions 10 are provided according to FIG. 2*a*, by way of two pressures P1 and P2, in the tubes 16. For contacting thereon, the tube 16 rolls upward in its receptacle, presently the chamber 11. The pressures P1 and P2 can be set independently of one another. In this way, different pressure profiles can be set in the extended nip 1.

Figure 2B:
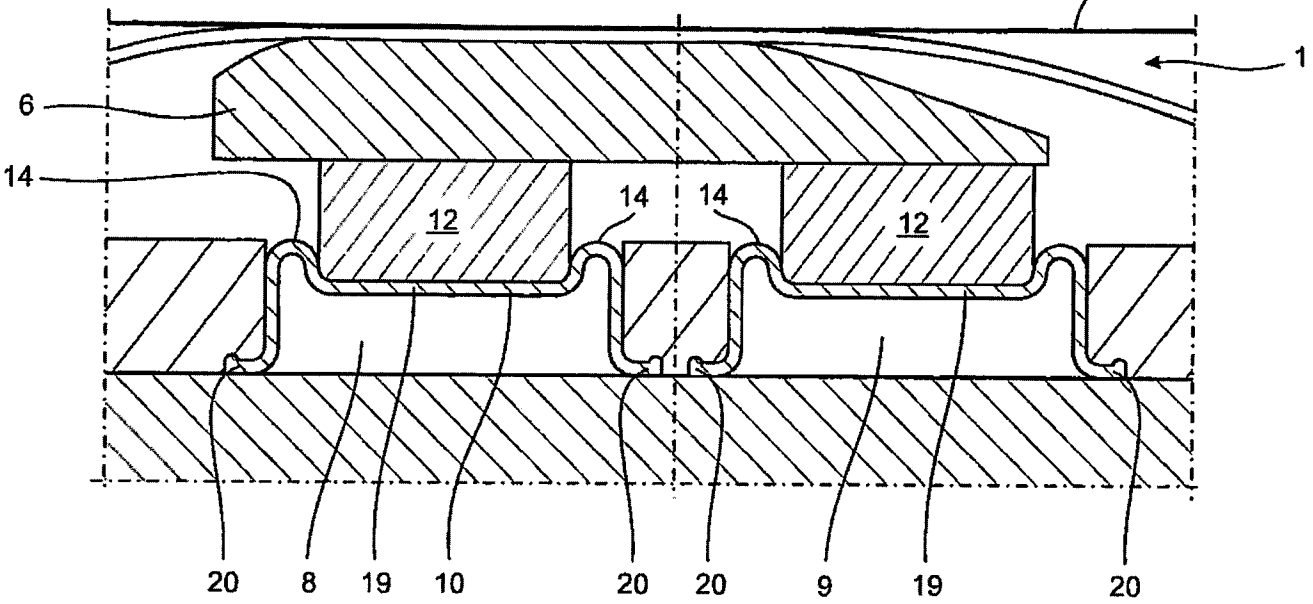

As an alternative to a tube, the pressure cushion 10 can be formed by a flexible shaped piece 19, which at the end side is clamped to fixing points 20, as is shown in FIG. 2*b*.

Figure 1B:
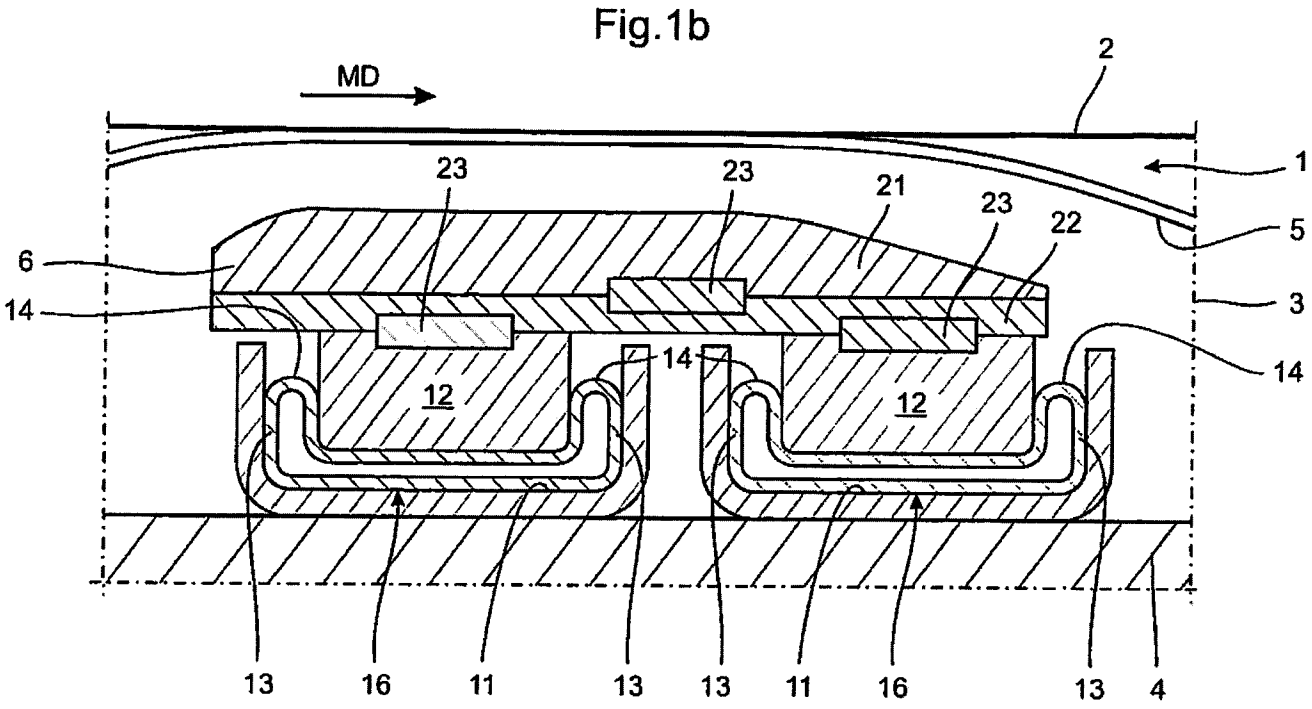

According to FIG. 1*b* the press shoe 6 can be embodied in a divided manner. This enables the press shoe 6 to be constructed from layers 21, 22 of different materials. These layers 21, 22 in relation to one another can be guided in the machine direction (MD), for example by means of fitting keys 23 or screws. Due to differences in temperature, the layer 21 can bend in relation to the layer 22. The layers 21, 22 can be freely displaceable in the machine cross direction (CD). The same may apply to the male form portions 12 below the press shoe 6.

As is shown in the described FIG. 1*a*, FIG. 1*b*, FIG. 2*a*, and FIG. 2*b*, the press shoe 6 in the machine direction (MD) can have at least two male form portions 12 which extend transversely to the machine direction in a spaced-apart manner and which are in each case assigned one groove-type chamber 11 having a pressure cushion 10 placed therein. Pressure loading of the several pressure cushions 10 is preferably performed in a variable manner.

Figure 3A:
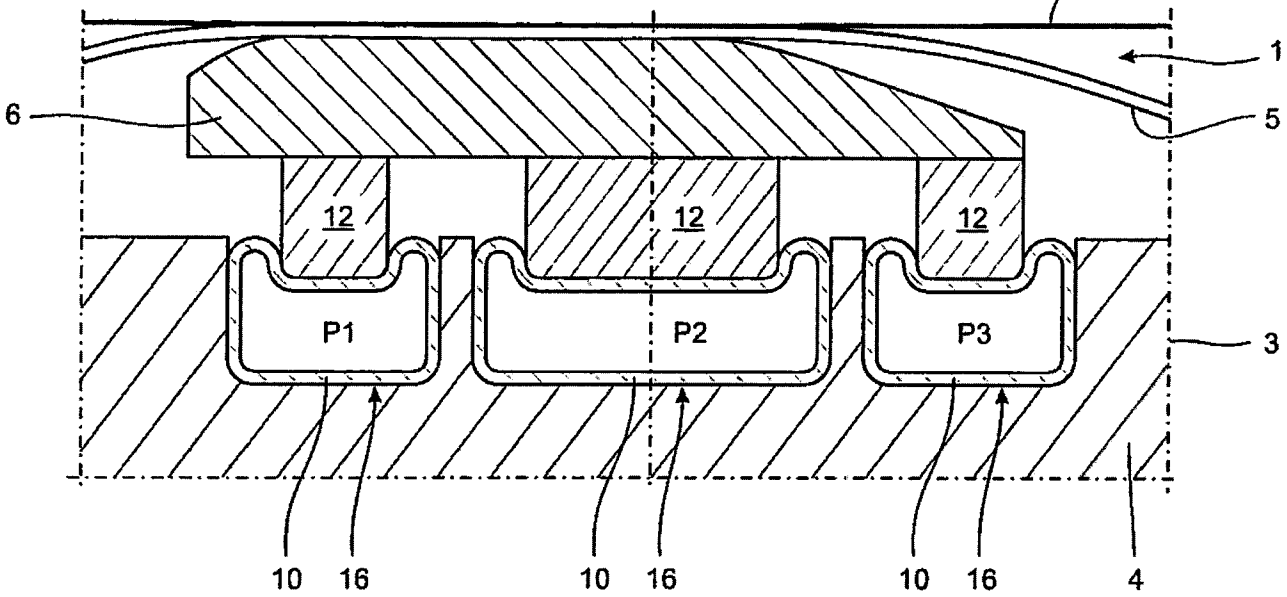

FIG. 3*a* shows an exemplary embodiment having three pressure cushions 10 made from U-shaped inlaid tubes 16, for example. The press shoe 6 then can be pressed against the mating roll 2 or a mating element, respectively, by way of three male form portions 12. The pressure P2 then is a primary operating pressure, for example, while the pressures P1 and P3 are pressures used for MD profiling.

Figure 3B:
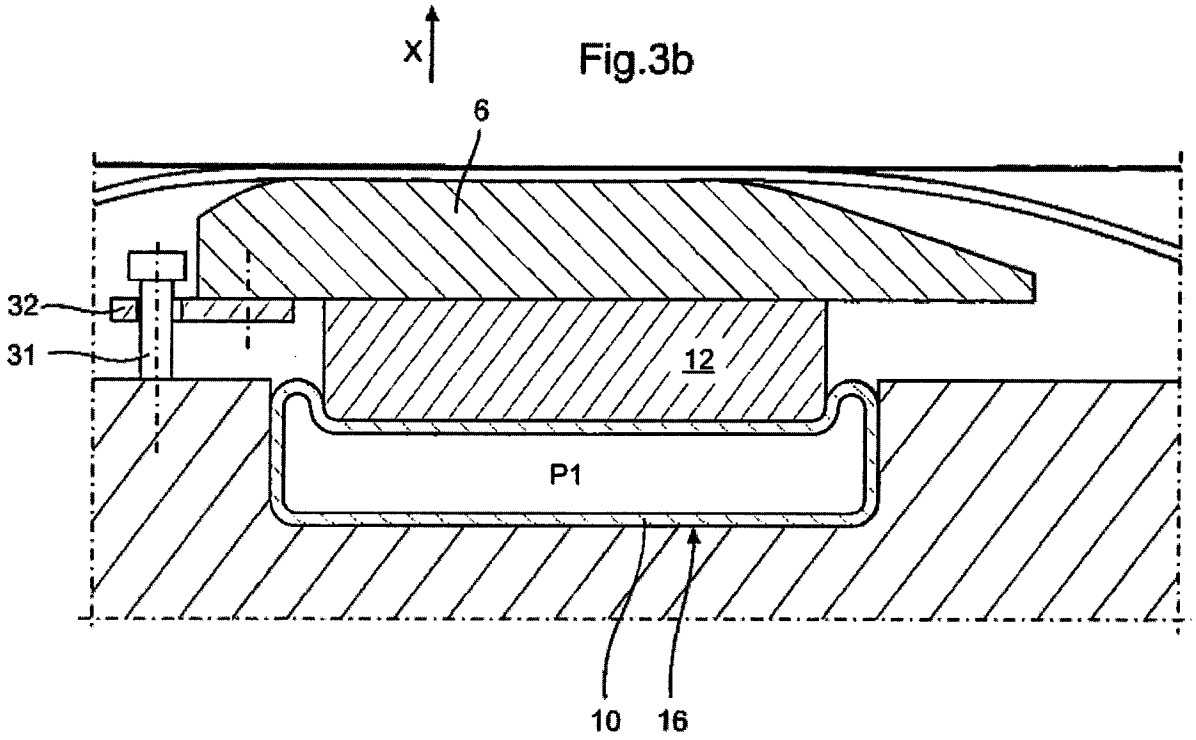
Figure 3C:
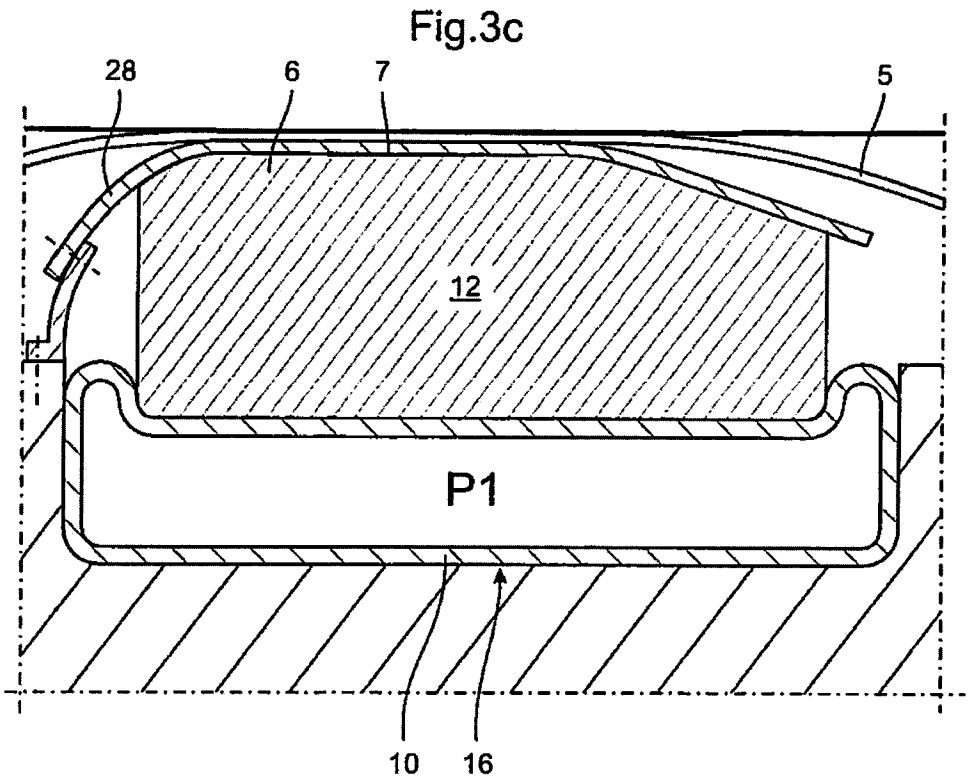

As is shown in FIG. 3*b* and FIG. 3*c*, the press shoe 6 can be pressed only by way of one male form portion 12 having an assigned pressure cushion 10, presently formed by a tube 16. FIG. 3*b* shows that the press shoe 6 here is connected to the carrier 4 and in relation to the latter is guided in the direction of pressure X by pins 31 and in a transverse manner thereto is held by mountings 32. This applies in a corresponding manner to the previously described exemplary embodiments.

Figure 4:
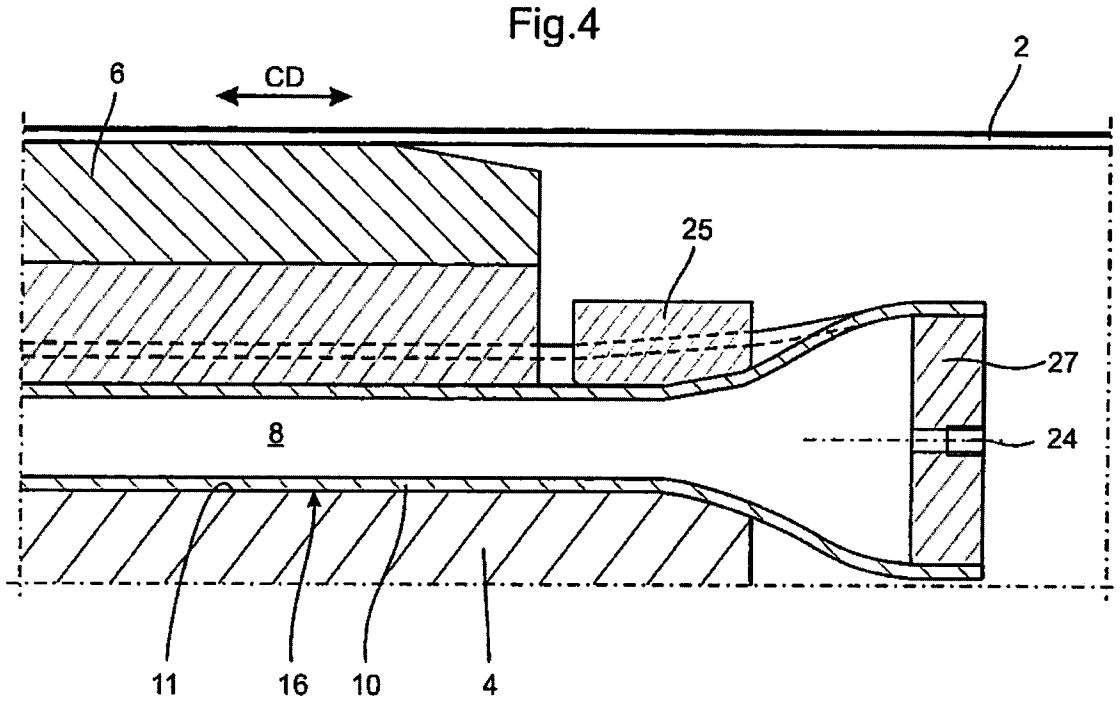
FIG. 4 shows schematically an apparatus for forming an extended nip, having a shoe roll according to the first exemplary embodiment, having a connector installation for fluid loading, in the longitudinal section and in a partial manner.
Figure 5:
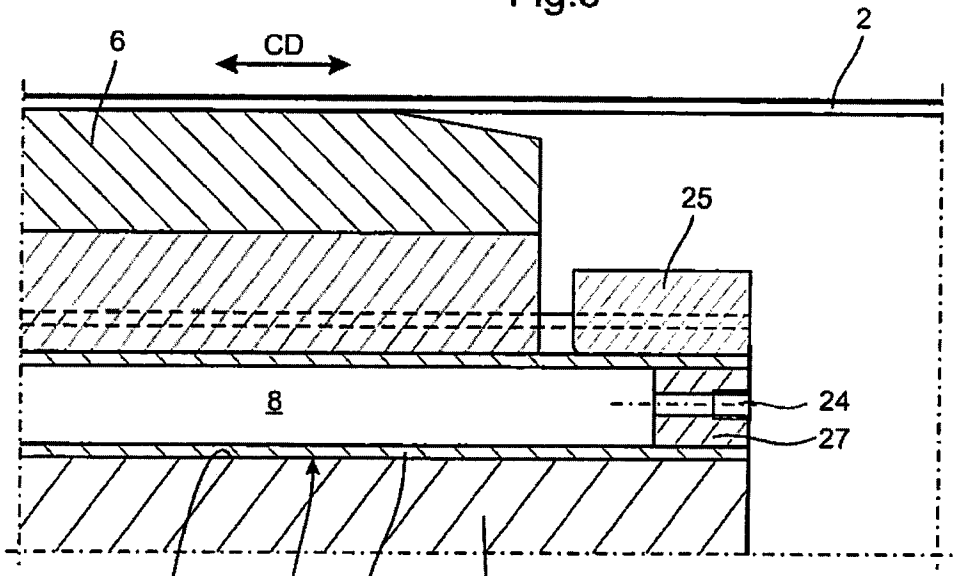
FIG. 5 shows schematically an apparatus for forming an extended nip, having a shoe roll according to the first exemplary embodiment, having another connector installation for fluid loading, in the longitudinal section and in a partial manner.

As is shown in FIG. 4 and FIG. 5 in the machine cross direction (CD), the axially extending tube 16 at the end side can have a lateral connector 27 for fluid loading 24. According to FIG. 4, this connector 27 is configured so as to be round, for example. Furthermore, a support element 25, which prevents force acting from the free tube end onto the press shoe 6, can be provided. According to FIG. 5, the lateral connector 27 is configured so as to be, for example, rectangular or U-shaped, like the tube 16 below the press shoe 6. The opposite end of the tube 16 can in each case be configured in a corresponding manner.

Figure 6:
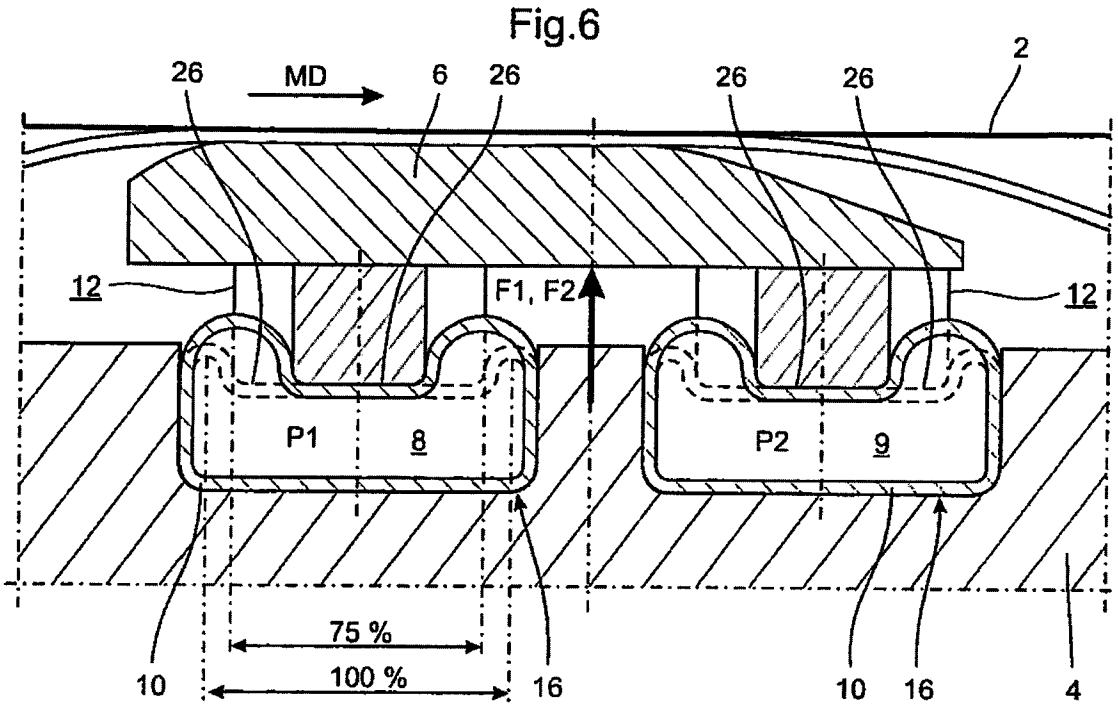
FIG. 6 shows schematically the apparatus according to FIG. 2*a*, for a seventh exemplary embodiment.

As is finally shown in FIG. 6, the male form portion 12 across the shoe length, that is to say in the machine cross direction (CD), can plunge into the respective pressure cushion 10 by way of variably sized bearing faces 26. The bearing face 26 of a male form portion 12 at the peripheries can be smaller than in the centre.

FIG. 7*b* to FIG. 7*d* in an exemplary manner show for a male form portion 12 (FIG. 7*a*) in the machine cross direction (CD) the line forces in the press zone of the press shoe 6 resulting therefrom. The comparatively small bearing faces 26 on the peripheral side lead to lower line loads in the peripheral region of the press shoe 6 than in the central region. The reduction in the effective thrust face can be 25%, for example, as is shown in FIG. 6.

The male form portion 12 having a comparatively small bearing face 26 can be assigned a separate force component F1, F2 for increasing a localized press force. The point of attack of these additional force components F1, F2 preferably lies between the exemplary two male form portions 12, as is clarified in FIG. 6 in conjunction with FIG. 7*a*. As is shown in FIG. 7*c*, using these additional force components a line load without the effect of the pressure cushion/pressure cushions 10 can only be adjusted in the peripheral region. As is shown in FIG. 7*d*, the peripheral load relief according to FIG. 7*b* can be compensated for across the shoe length by the additional force components F1 and F2 on the identical line load.

As is shown in FIG. 8*b* to FIG. 8*d*, the additional force components F1 and F2 can apply such additional pressures as is clarified in FIG. 8*c* so that despite the comparatively small bearing faces 26 the line loads for such a male form portion 12 according to FIG. 8*a* at the peripheral side are higher than in a central region.

In the case of all exemplary embodiments a cloth 28 can be placed as wear protection between the head face 7 of the press shoe 6 and the roll shell 5, as is illustrated in an exemplary manner in FIG. 3*c*. This cloth 28 is preferably thermally resistant and can be composed of a material comparable to that of the roll shell 5.

The apparatus described above may find use as a wet press or a calender.

The invention claimed is:

1. Apparatus for forming an extended nip between a mating roll and a shoe roll for treating a material web, the shoe roll having a carrier and a flexible roll shell rotatable about the carrier, which roll shell is supported in the region of the extended nip on a head face of a press shoe which is guided on the carrier, and the press shoe for generating a pressure is movably supported on the carrier using a fluid-load pressure chamber, the pressure chamber being configured as a pressure cushion on which the press shoe by way of the rear side is supported in a planar manner, wherein the pressure cushion is placed in a groove-type chamber, wherein the press shoe on the rear side has a male form portion, which projects into a pressure cushion which can be sunk, and the pressure cushion to this end is supported in a guiding manner by way of a pressure-cushion side wall, which forms a rollable wall, on the groove-type chamber, wherein the rollable wall forms a rolling fold between the male form portion of the press shoe and an inner side wall of the groove-type chamber, wherein a rolling behavior of rolling fold determines a lifting length in a lifting direction (X), and wherein a distance (Y) between the male form portion of the press shoe and an inner side wall of the groove-type chamber is selected in such a manner that the rollable wall during displacement of the male form portion in the lifting direction (X) is pressed against the inner side wall of the groove-type chamber.

2. Apparatus according to claim 1, wherein a fluid-loadable flexible tube is placed as a pressure cushion in the axially extending groove-type chamber, the tube comprising two material layers, which in the cross section are disposed on top of one another, are placed in a U-shape in the groove-type chamber in such a manner that the tube folds of the leg ends of the tube which is placed in a U-shaped manner form the rollable wall.

3. Apparatus according to claim 2, wherein the male form portion which is engaged for lifting to the pressure cushion during performing lifting movements is enclosed by the tube in a U-shaped cross-sectional manner.

4. Apparatus according to claim 2, wherein the tube is composed of a fibre-reinforced plastic material or a fibre-reinforced rubber compound.

5. Apparatus according to claim 1, wherein the rollable wall is integrally configured with a flexible forming part and is clamped at the end sides.

6. Apparatus according to claim 1, wherein the press shoe in the machine direction (MD) has at least two male form portions which extend across the machine direction (CD) in a spaced-apart manner and which are in each case assigned one groove-type chamber having a pressure cushion placed therein.

7. Apparatus according to claim 6, wherein pressure loading of the plurality of pressure cushions is performed in a variable manner.

8. Apparatus according to claim 1, wherein the male form portion in the longitudinal direction of the shoe plunges into the respective pressure cushion by way of variably sized bearing faces.

9. Apparatus according to claim 8, wherein the bearing face of a male form portion at the peripheries is smaller than in the centre.

10. Apparatus according to claim 8, wherein the male form portion having a comparatively small bearing face is assigned at least one separate force component (F1, F2) for increasing a localized pressing force.

11. Apparatus according to claim 1, wherein the pressure cushion at the front side and/or end side in the longitudinal direction of the shoe has connector installations for fluid loading.

12. Apparatus according to claim 1, wherein for protecting the head face of the press shoe, a cloth is provided as wear protection between the head face and the roll shell.

13. Apparatus for forming an extended nip between a mating roll and a shoe roll for treating a material web, the shoe roll having a carrier and a flexible roll shell rotatable about the carrier, which roll shell is supported in the region of the extended nip on a head face of a press shoe which is guided on the carrier, and the press shoe for generating a pressure is movably supported on the carrier using a fluid-load pressure chamber, wherein the press shoe is constructed from two layers of different materials, the two layers being guidable in a machine direction while being freely displaceable in a machine cross direction, the pressure chamber being configured as a pressure cushion on which the press shoe by way of the rear side is supported in a planar manner, wherein the pressure cushion is placed in a groove-type chamber, wherein the press shoe on the rear side has a male form portion, which projects into a pressure cushion which can be sunk, and the pressure cushion to this end is supported in a guiding manner by way of a pressure-cushion side wall, which forms a rollable wall, on the groove-type chamber.

14. Apparatus for forming an extended nip between a mating roll and a shoe roll for treating a material web, the shoe roll having a carrier and a flexible roll shell rotatable about the carrier, which roll shell is supported in the region of the extended nip on a head face of a press shoe which is guided on the carrier, and the press shoe for generating a pressure is movably supported on the carrier using a fluid-load pressure chamber, the pressure chamber being configured as a pressure cushion on which the press shoe by way of the rear side is supported in a planar manner, wherein the pressure cushion is placed in a groove-type chamber, wherein the press shoe on the rear side has a male form portion, which projects into a pressure cushion which can be sunk, and the pressure cushion to this end is supported in a guiding manner by way of a pressure-cushion side wall, which forms a rollable wall, on the groove-type chamber, wherein a fluid-loanable flexible tube is placed as a pressure cushion in the axially extending groove-type chamber, wherein a support element is in contact with the tube and prevents force acting from a free end of the tube onto the press shoe.

* * * * *